United States Patent [19]

Miller

[11] 4,185,315

[45] Jan. 22, 1980

[54] APPARATUS WITH A SINGLE INPUT CONNECTABLE TO ELECTRICAL ENERGIZING SOURCES OF DIFFERENT CHARACTER

[75] Inventor: Robert L. Miller, Horsham, Pa.

[73] Assignee: Honeywell Inc., Minneapolis, Minn.

[21] Appl. No.: 832,874

[22] Filed: Sep. 13, 1977

Related U.S. Application Data

[63] Continuation of Ser. No. 725,888, Sep. 23, 1976, abandoned.

[51] Int. Cl.[2] ..... H01H 47/32

[52] U.S. Cl. ..... 361/205; 307/72; 307/80; 307/130

[58] Field of Search ..... 361/205; 323/22 SC; 307/22, 43, 48, 56, 64, 66, 72, 73, 75, 80, 130, 146, 151

[56] References Cited

U.S. PATENT DOCUMENTS

| | | | |
|---|---|---|---|
| 3,471,771 | 10/1969 | Mortimer | 323/22 SC |
| 3,644,783 | 2/1972 | Snyder | 315/127 |
| 3,737,761 | 6/1973 | Walther | 307/130 |
| 3,997,818 | 12/1976 | Bodkin | 361/100 |
| 4,001,668 | 4/1977 | Lewis | 323/19 |

OTHER PUBLICATIONS

"SCR, Elements and Applications", Ozu 7/30/69, pp. 36–39.

"SCR Manual", 4th Ed.-GE 1967, Chapters 9–10, (pp. 173–223).

*Primary Examiner*—Harry E. Moose, Jr.

*Attorney, Agent, or Firm*—Laurence J. Marhoefer; Lockwood D. Burton; Mitchell J. Halista

[57] ABSTRACT

A portion of the apparatus, which requires low voltage DC energy for its energization, is connected in series with an SCR between a single pair of input or energizing terminals. A series RC circuit is connected across the SCR, and the junction within this series circuit is connected through a zener diode to the gate of the SCR. When low voltage DC is applied between the input terminals, it turns on the SCR continuously and effectively appears across the noted apparatus portion to properly energize the latter. When high voltage AC is applied between the same input terminals, it turns on the SCR for only a predetermined part of each cycle of the AC. This part is made to be such that the resulting voltage across the noted apparatus portion is effectively the same when the high voltage AC is applied between the input terminals as it is when the low voltage DC is applied between the same input terminals.

6 Claims, 4 Drawing Figures

APPARATUS WITH A SINGLE INPUT CONNECTABLE TO ELECTRICAL ENERGIZING SOURCES OF DIFFERENT CHARACTER

This is a continuation of application Ser. No. 725,888, filed Sept. 23, 1976, now abandoned.

BACKGROUND OF THE INVENTION

1. Field of the Invention

The present invention relates generally to electrical apparatus which is designed to operate when energized or powered from either of two different sources of electrical energy, each of which supplies energy of a character or form which is radically different from that of the energy supplied by the other of the sources. Such apparatus is often referred to as dual or two-way powered apparatus. Specifically, the invention relates to apparatus of the noted type which has the capability of being connected to and powered by either a low voltage direct current or DC energy source, such as a battery, or a high voltage alternating current or AC energy source, such as the usual AC supply or distribution system. More specifically, the present invention relates to apparatus as just defined which includes a portion or component requiring low voltage DC energy to energize or power it, and which furnishes such energy to said portion when the apparatus is connected to either of the noted DC and AC sources.

As used herein, the term low voltage DC energy or low voltage DC means energy at a DC voltage which is relatively low with respect to the voltage of the usual AC system, and which may be of the order of 6 to 30 volts. Similarly, the term high voltage AC energy or high voltage AC, as used herein, means energy at an AC voltage which is relatively high with respect to the above-defined low DC voltage, and which is usually of the order of 120 or 240 volts.

2. Description of the Prior Art

Dual powered apparatus of the type noted above, which can be energized or powered by connecting it either to a low voltage DC source, such as a battery, or to an AC system, is known in the art. Examples of such known apparatus are the numerous available radio and television receivers, tape recorders, testing apparatus, and similar equipment which can be powered either by being connected to an external battery, such as that contained in an external battery pack or that employed in an automotive vehicle, or by being plugged into a receptacle of an AC system.

Each of the arrangements of the type just described with which I am familiar requires and effectively includes two sets or pairs of input or energizing terminals. One of these pairs of terminals is provided for connecting the apparatus to the AC system, and the other pair of these terminals is provided for connecting the apparatus to the battery or other DC energy source. Each of these pairs of terminals is so internally connected to the circuitry of the apparatus that the terminals of the pair must be connected only to the designated type of energy source, and must not be connected to the type of source for which the other pair of terminals is provided. Although each of these pairs of terminals is usually associated with the type of conductor or cord set which is normally associated only with the corresponding type of energy source, care must still be exercised to prevent either pair of terminals from inadvertently being connected to the wrong type of energy source. For example, if the low voltage DC input terminals are inadvertently connected to the AC system, tripped circuit breakers, blown fuses, and/or damage to the equipment are likely to result. Therefore, the presence of two sets of input terminals in the known arrangements, and the need for connecting each set of terminals only to its designated energy source, amount to undesirable characteristics or shortcomings of those arrangements.

Moreover, each arrangement of the last-noted type requires some form of mechanical or electrical interlock device to afford the needed protection in the event that both sets of input terminals are connected to their respective energy sources simultaneously. This is especially true where the apparatus is utilized with an associated external battery pack. Such interlock devices necessarily add to the complexity and cost of the apparatus and are a potential source of problems. They thus constitute a further shortcoming of the known apparatus.

It is also known in the art to provide arrangements which, when connected to a high volume AC energy source, utilize semiconductor switches and adjustable RC triggering circuits to furnish variable voltage AC or DC energy to high voltage AC or DC load devices, such as lamps and motors. Arrangements of this type are used extensively as lamp dimmers and motor speed controllers. Examples of these and other similar arrangements are the arrangements which are illustrated throughout Chapters 9 and 10 (Pages 173 through 223) of the General Electric *Silicon Controlled Rectifier Manual,* 4th edition, published in 1967. However, none of the known arrangements of this type of which I am aware is arranged or used to furnish effectively the same low voltage DC energy to a low voltage DC device when energized through a single set of input terminals from either a low voltage DC energy source or a high voltage AC energy source.

SUMMARY OF THE INVENTION

Accordingly, it is an object of the present invention to provide improved apparatus of the above-noted dual powered type which avoids the noted undesirable characteristics of the previously known forms of such apparatus by eliminating the need for two pairs of input or energizing terminals, while still being capable of being energized from either a low voltage DC source or a high voltage AC source. Specifically, it is an object of the invention to provide such improved apparatus wherein a portion, which may be an entire circuit or merely a single component such as a low voltage DC solenoid or a low voltage DC relay coil, is supplied with its needed low voltage DC energizing energy when a single pair of input terminals is connected either to a low votage DC source, such as a battery, or to an AC system.

A more specific object of the invention is to provide such improved apparatus wherein the single pair of input terminals can be connected, as desired by a used, either to a battery or to an AC system without requiring the manual actuation of any switches, without requiring the presence of any interlock devices, and without creating any possibility of connecting the wrong energy source to the wrong input of the apparatus, and wherein the apparatus automatically furnishes effectively the same low voltage DC energy to the portion requiring it no matter to which of the two energy sources the single pair of input terminals is connected.

To the end of accomplishing the above-noted and other desirable objects, dual powered apparatus according to the present invention, and including a portion requiring low voltage DC energizing energy, also includes only the noted single pair of input or energizing terminals. A relatively simple energy controlling electronic circuit, requiring only a semiconductor switch, a triggering device, a resistor, and a capacitor, connects the single pair of input terminals to said portion of the apparatus which requires the low voltage DC energizing energy. When these two input terminals are connected to a source of low voltage DC energy, the circuit causes the switch to pass this energy continuously to said portion for energizing the latter. When the same two input terminals are instead connected to the source of high voltage AC energy, the circuit suitably conditions the AC energy automatically so that, again, only the needed low voltage DC energy is supplied to said portion. The circuit accomplished this by turning on the switch for only a predetermined part of each cycle of the AC energy. Thus, said portion is automatically properly energized with low voltage DC energy no matter whether the single pair of input terminals is connected to the low voltage DC energy source or to the high voltage AC energy source. Since only one pair of energizing or input terminals is required and provided, there is no danger of an incorrect connection of either source to the apparatus, and no need for any manual switching or any interlock device.

BRIEF DESCRIPTION OF THE DRAWINGS

A better understanding of the present invention may be had from the following detailed description when read in connection with the accompanying drawings, wherein.

DETAILED DESCRIPTION OF THE PREFERRED EMBODIMENTS

THE APPARATUS OF FIG. 1

Figure 1:
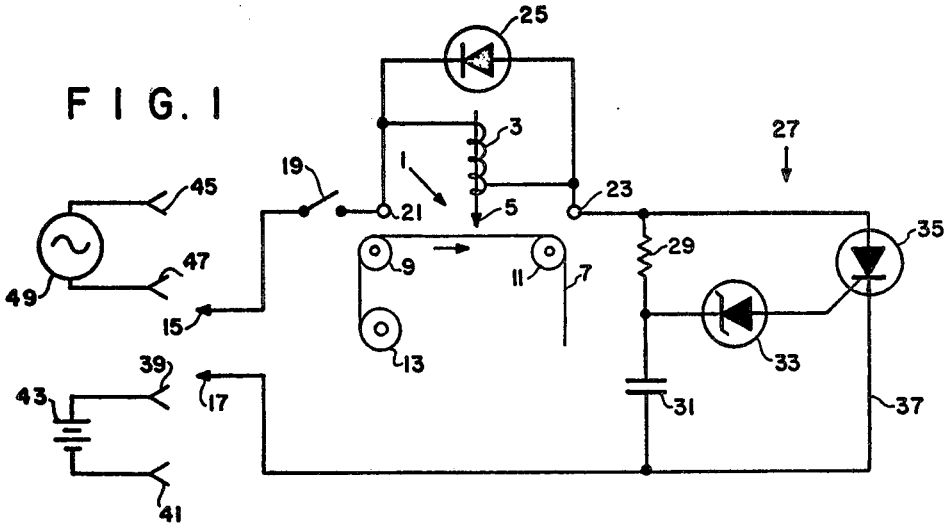
FIG. 1 is a diagrammatic representation of graphic recording apparatus which embodies the present invention and wherein the portion requiring low voltage DC energizing energy is a record marking device.

The apparatus shown in FIG. 1, and illustrating a preferred example of the above-described improved apparatus embodying the present invention, is graphic record-producing or recording apparatus of the known type which includes the usual moving record medium or chart and cooperating recording means. The function of the latter is to produce on said chart a record of the value of some designated variable quantity or condition.

The FIG. 1 apparatus additionally includes a chart marking device in the form of a so-called event pen which marks the chart, to record the times of occurrence of a certain event, when the event pen is supplied with low voltage DC energy. Accordingly, this event pen is the portion of the FIG. 1 apparatus which requires low voltage DC energy for its energization. In accordance with the present invention, the apparatus includes but a single pair of energizing terminals, and yet automatically provides the low voltage DC energy needed for powering the event pen when that single pair of terminals is connected either to a source of low voltage DC energy or to a source of high voltage AC energy.

In accordance with the foregoing brief description of the FIG. 1 apparatus, the latter includes an event pen device 1. This device consists of a low voltage DC solenoid 3 and a cooperating marking element or pen element 5. The term low voltage DC solenoid identifies a solenoid which must be energized and operated only by low DC voltage lying within a specified range. Whenever the solenoid 3 is energized with such low voltage DC, it causes the element 5 to move into marking contact with a record medium or chart 7. The latter is normally continuously moved over rollers 9 and 11 and past the element 5 from a chart supply roll 13. This movement is imparted to the chart 7 by the usual chart drive means. Such means, as well as the recording means which produces the noted record on the chart 7, are assumed to be of convention form, and have been omitted from the FIG. 1 showing in order to avoid unduly complicating the figure. It is considered that the illustration of such chart driving and recording means is not necessary to an understanding of the present invention or its embodiments.

In addition to the low voltage DC solenoid 3, the circuit of the FIG. 1 apparatus includes a single pair of energizing or input terminals 15 and 17, a switch 19 for selectively controlling the marking operation of the solenoid 3, DC power or load terminals 21 and 23 by means of which the solenoid 3 is connected to the remainder of the apparatus, a diode 25, and an energy controlling circuit portion 27. The latter includes a resistor 29, a capacitor 31, a triggering device 33 in the form of a breakdown diode of the zener type, and a silicon controller rectifier (SCR) 35. The switch 19 constitutes the usual so-called on-off or power switch of the apparatus, and its inclusion therein is not essential to having the apparatus operate in accordance with the present invention.

The above-described elements and portions of the FIG. 1 apparatus are interconnected in the following manner. The input terminal 15 is connected through the switch 19 to the terminal 21 which, in turn, is connected to one end of the solenoid 3. The remaining end of the latter is connected to the terminal 23 which, in turn, is connected to one end of the resistor 29 and to the anode of the SCR 35. The cathode of the latter is connected by a conductor 37 to the remaining input terminal 17. Accordingly, the switch 19, the solenoid 3, and the anode and cathode of the SCR 35 are connected in series between the terminals 15 and 17. The diode 25 is connected across the solenoid 3.

The remaining end of the resistor 29 is connected through the capacitor 31 to the conductor 37, whereby the voltage which appears across the anode and cathode of the SCR 35 also appears across the series combination of the resistor 29 and the capacitor 31. The junction between the latter two elements is connected through the zener diode 33 to the gate of the SCR 35.

OPERATION OF THE APPARATUS OF FIG. 1

As previously noted, the FIG. 1 apparatus automatically provides the low voltage DC energy needed for powering the solenoid 3 of the event pen device 1 when the apparatus is energized or powered either with low voltage DC energy or with high voltage AC energy. Specifically, the low voltage DC energy required by the solenoid 3 is automatically provided in the FIG. 1 apparatus when the terminals 15 and 17 are connected either to the terminals of a low voltage DC energy source or to the terminals of a high voltage AC energy source. An example of such DC source terminals is shown at 39 and 41 in FIG. 1, and these terminals are shown as being connected to the respective positive and negative terminals of a low voltage battery 43. An example of such AC source terminals is shown in FIG. 1 at 45 and 47, and these terminals are shown as being connected across a high voltage AC source 49, which represents a conventional AC supply or distribution system.

There will now be described the specific operation of the FIG. 1 apparatus which takes place, upon the closure of the switch 19, when the input terminals 15 and 17 are connected to the respective terminals 39 and 41 of the low voltage DC source 43. Upon such closure of the switch 19, a voltage from the source 43 appears across the capacitor 31. This voltage, which makes the upper terminal of the capacitor 31 positive with respect to its lower terminal, rapidly rises to that value which causes the zener diode 33 to become conductive. When this occurs, the resulting current flow into the gate of the SCR 35 turns on the latter. As a result, the solenoid 3 is then effectively connected across the low voltage DC source 43, and so becomes energized to move the element 5 into marking engagement with the chart 7. This energization and engagement continue until the switch 19 is opened, at which time the flow of power to the solenoid 3 is interrupted and the SCR 35 turns off.

Consequently, each closure of the switch 19 turns on the SCR 35, powers the solenoid 3 from the source 43, and causes the marking of the chart 7 by the element 5 for substantially the time period during which the switch 19 remains closed. As previously noted, such marking of the chart 7 is usually done to provide a record of the times of occurrence of an event. Consequently, the usual means, not shown, would be included in the FIG. 1 apparatus to effect a temporary closure of the switch 19 for each occurrence of said event.

Turning now to the specific operation which takes place when the input terminals 15 and 17 are connected to the respective terminals 45 and 47 of the high voltage AC source 49, it is noted that, for this connection, the closure of the switch 19 causes an AC voltage from the source 49 to appear across the capacitor 31. The resulting operation will be described from the start of the first half cycle of the AC voltage from the source 49 which is in the direction to make the terminal 15 positive with respect to the terminal 17, and to make the upper terminal of the capacitor 31 positive with respect to its lower terminal.

From the start of this first positive half cycle, a voltage rises across the capacitor 31 which makes the upper terminal thereof positive with respect to the lower terminal. At some point in this half cycle, this rising voltage reaches that value which causes the zener diode 33 to become conductive. When this occurs, the resulting current flow into the gate of the SCR 35 turns on the latter. As a result, current than flows through the solenoid 3 to energize the latter and to cause it to move the element 5 into marking engagement with the chart 7.

The noted energization of the solenoid 3 continues until that time in the AC voltage cycle being considered at which this voltage drops to the value at which the SCR 35 turns off. For the succeeding or negative half cycle, the SCR 35 is reverse biased and remains off, and does not turn on again until the time in the succeeding positive half cycle at which it is turned on by the current through the zener diode 33. In each such negative half cycle, the noted positive voltage across the capacitor 31 is dissipated so that the capacitor can properly control the turn-on time of the SCR 35 during the succeeding positive half cycle. Accordingly, the SCR 35 remains off, and current flow through the solenoid 3 is interrupted, from the time in each positive half cycle at which the SCR 35 turns off to the time in the next positive half cycle at which the SCR 35 is again turned on. Consequently, current flows through the solenoid 3 for only a part of each cycle of the AC energy from the source 49.

The values and characteristics of the resistor 29, the capacitor 31, the zener diode 33, and the SCR 35 are made to be such that the duration of each of the noted parts of the AC cycles, during which current flows through the solenoid 3, is such that the average DC voltage drop across the solenoid 3 is substantially the same as that which occurs across the solenoid 3 when the terminals 15 and 17 are connected across the battery 43. The diode 25 serves to circulate the inductive current through the winding 3 as the magnetic field collapses during each AC cycle, and thereby permits the SCR to turn off in the manner described above. This same action of the diode 25 also prevents the element 5 from chattering while the switch 19 is closed.

Consequently, when the terminals 15 and 17 are connected to the respective high voltage AC source terminals 45 and 47, the closure of the switch 19 causes the SCR 35 to pass current through the solenoid 3 for only a predetermined part of each cycle of the AC energy, the duration of each of these parts being such that the solenoid 3 is energized in effectively the same manner as it is when the terminals 15 and 17 are connected to the respective low voltage DC source terminals 39 and 41. Thus, each such closure of the switch 19 suitably powers the solenoid 3 from the source 49, and causes the marking of the chart 7, as long as the switch 19 remains closed.

In summary, when the terminals 15 and 17 are connected, respectively, to the low voltage DC source terminals 39 and 41, each closure of the switch 19 causes low voltage DC energy from the source 43 to be applied to the solenoid 3 for energizing the latter. When so energized, the solenoid 3 causes the element 5 to make a suitable mark on the moving chart 7, the position of this mark on the chart providing a record of the time at which the switch 19 was so closed. Similarly, when the terminals 15 and 17 are instead connected, respectively, to the high voltage AC source terminals 45 and 47, each closure of the switch 19 again causes low voltage DC energy to be applied to the solenoid 3 for energizing the latter and causing the element 5 to mark the chart 7. Moreover, by the proper selection of the values of the elements 29, 31, 33, and 35, the low voltage DC which is supplied to the solenoid 3 when the terminals 15 and 17 are connected to the high voltage AC source 49 is made to be effectively the same as that which is supplied to the solenoid 3 when the terminals 15 and 17 are connected instead to the battery 43.

TYPICAL VALUES P By way of illustration and example, and not by way of limitation, it is noted that, in apparatus of the form shown in FIG. 1 which was constructed for use with, and operated from, a low voltage DC energy source supplying 24 volts and a high voltage AC energy source supplying 120 volts at 60 hertz, the circuit components of the apparatus has the following values:

Solenoid 3: 24 VOLTS DC
Diode 25: 1N4003
Resistor 29: 29.4 K OHMS
Capacitor 31: 0.22 MFD.
Zener Diode 33: 1N967B, 18 VOLTS
SCR 35: 2N5064.

THE APPARATUS OF FIGURE 2

Figure 2:
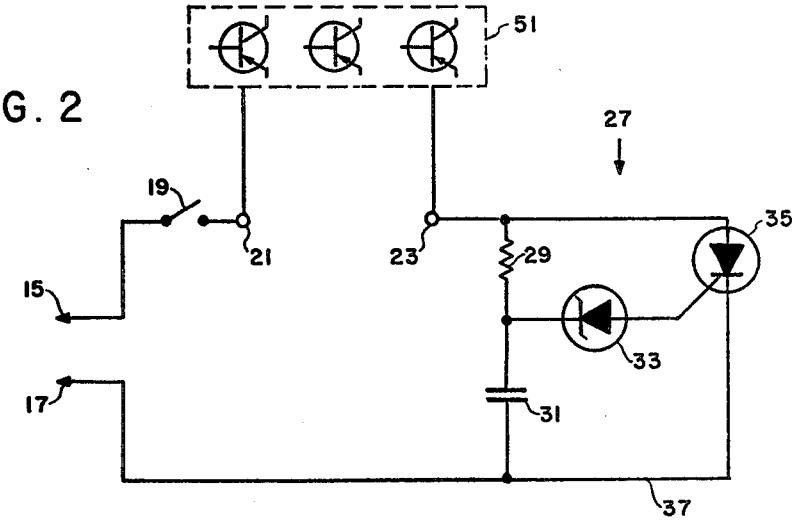
FIG. 2 is a diagrammatic representation of a typical piece of electronic equipment according to the present invention, wherein the portion requiring low voltage DC energy is a semiconductor circuit.

The apparatus shown in FIG. 2 illustrates another example of the above-described improved apparatus embodying the present invention. The FIG. 2 apparatus represents a typical piece of electronic equipment of the type which includes a solid state or semiconductor circuit as a portion, into which equipment the energy controlling circuit portion 27 of FIG. 1 has been combined. Thus, the FIG. 2 apparatus may be a solid state radio receiver, a piece of test equipment, or the like. The circuit portion 27 has been so included in the FIG. 2 apparatus in order to permit that apparatus to have but a single pair of input terminals, and yet to furnish to its semiconductor circuit portion the low voltage DC powering energy which such a circuit portion requires when said single set of terminals is connected either to a low voltage DC energy source or a high voltage AC energy source, such as the sources illustrated by way of example in FIG. 1. Therefore, the FIG. 2 apparatus illustrates the manner, according to the present invention, in which the circuit portion 27 can be utilized in a typical piece of electronic equipment, as well as in the FIG. 1 graphic recorder, to permit such equipment to be powered by way of a single pair of input terminals from either of low voltage DC or high voltage AC energy sources.

In accordance with the foregoing, the FIG. 2 apparatus includes the input terminals 15 and 17, the switch 19, the load terminals 21 and 23, and the circuit portion 27 with its elements 29, 31, 33, 35, and 37. These components bear the same reference numerals in both of FIGS. 1 and 2 because they serve essentially the same purpose in both of the arrangements of those figures. The semiconductor circuit portion of the FIG. 2 equipment, requiring low voltage DC for its energization, is shown in generalized form at 51, and is shown as being connected between the terminals 21 and 23 to receive such energization.

OPERATION OF THE APPARATUS OF FIG. 2

As in the case of the apparatus of FIG. 1, the FIG. 2 apparatus automatically provides the low voltage DC energy needed for powering its portion requiring such energy when the apparatus is energized or powered either from a low voltage DC energy source such as the source 43, or from a high voltage AC energy source such as the source 49. Specifically, when the terminals 15 and 17 of the FIG. 3 apparatus are connected to the low voltage DC energy source terminals, such as the terminals 39 and 41, the closure of the switch 19 turns on the SCR 35. As a result, the portion 51 is then effectively connected across the low voltage DC energy source, and so receives the powering energy which it requires. This energization of the portion 51 continues as long as the switch 19 remains closed. Again, the presence of such a switch is not essential to the operation of the apparatus in accordance with the present invention.

When the terminals 15 and 17 are connected instead to the terminals of a high voltage AC energy source, such as the terminals 45 and 47, energizing energy is supplied to the portion 51 for only a part of each cycle of the AC energy in the same manner as that described above in connection with the operation of the FIG. 1 apparatus. Consequently, as long as the switch 19 remains closed, the portion 51 is supplied with the needed low voltage DC energy. Again, the values and characteristics of the resistor 29, the capacitor 31, the zener diode 33, and the SCR 35 are made to be such that the duration of the parts of the AC cycles during which current flows through the portion 51 are such that the average DC voltage drop across the portion 51 is effectively the same as that which is produced across the portion 51 when the terminals 15 and 17 are connected to the source of low voltage DC energy.

THE APPARATUS OF FIG. 3

Figure 3:
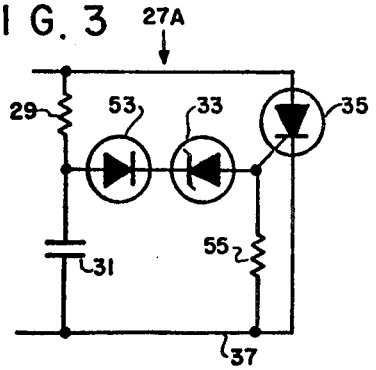
FIG. 3 is a diagrammatic representation of a modified form of the energy controlling circuitry portion of the apparatus of either FIG. 1 or FIG. 2.

FIG. 3 shows a modified form of the energy controlling circuitry portion 27 of the apparatus of either FIG. 1 or FIG. 2. In FIG. 3, this modified portion is identified by the reference character 27A, and differs from the portion 27 only in that a diode 53 is added in series with the zener diode 33, and in that a resistor 55 is connected between the gate and the cathode of the SCR 35. One purpose of the diode 53 is to prevent any significant flow of SCR gate leakage current through the zener diode 33, which current might otherwise interfere with the proper timing action of the capacitor 31 when the apparatus is powered with AC energy. The purpose of the resistor 55 is to provide a path for such leakage current which does not involve the capacitor 31. A second purpose of the diode 53 is to positively prevent the SCR 35 from being turned on by a negative voltage between the top and bottom terminals of the capacitor 31.

Aside from the foregoing, the operation of the portion 27A is the same as that previously described for the portion 27 in connection with the description of the operation of the FIG. 1 apparatus. When used along with the components whose values are listed above, the diode 53 may well be a 1N4003 diode, and the resistor 55 may well have a value of 22 K Ohms.

THE APPARATUS OF FIG. 4

Figure 4:
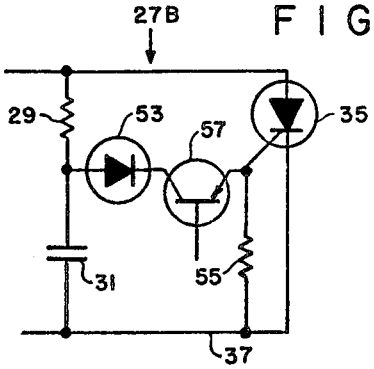
FIG. 4 is a diagrammatic representation of a further modification of said circuitry portion.

FIG. 4 shows a modified form of the energy controlling circuitry portion 27A of FIG. 3. In FIG. 4, this modified portion is identified by the reference character 27B, and differs from the portion 27A only in that the zener diode 33 is replaced by a transistor 57. The purpose of so using the transistor 57 as a triggering breakdown device in place of the zener diode 33 is to obtain the benefits of the sharper breakdown characteristic which a transistor provides in comparison to a zener diode. When used along with the components whose values are listed above, the transistor 57 may well be a 2N3906 transistor selected to have a breakdown voltage of 6.6 volts. When such a transistor was employed in the noted constructed apparatus, the value of the resistor 29 was changed to 37.4 K Ohms.

It is believed to be clear from the foregoing description that the described apparatus according to the present invention fulfills the objects stated herein. Thus, it has been shown that the apparatus automatically furnishes effectively the same low voltage DC energy to the portion requiring it when the single pair of input terminals of the apparatus is connected to either a low voltage DC energy source or a high voltage AC energy source, and that the apparatus does this without requiring any manual switching, complicated circuitry, or interlock devices.

The embodiments of the invention in which an exclusive property or privilege is claimed are defined as follows:

1. Apparatus for automatically delivering relatively low voltage DC energy to a portion requiring such energy when said apparatus is connected to either of two energy sources, one of said sources providing relatively low voltage DC energy and the other of said sources providing relatively high voltage AC energy, said apparatus comprising a portion requiring for its energization relatively low voltage DC energy, a pair of input terminals arranged for selective connection to either of said two sources, a semiconductor switch device having a pair of principal electrodes, means connecting said portion and said principal electrodes between said terminals, and circuit means connected to said switch device for turning on said switch device, when said terminals are connected to said one source, to apply to said portion its required relatively low DC voltage as derived from the energy of said one source, and for turning on said switch device for only a part of each cycle of said AC energy when said terminals are connected to said other source, the duration of said parts being such that effectively the same voltage is applied across said portion when said terminals are connected to said other source as is applied across said portion when said terminals are connected to said one source.

2. Apparatus for automatically delivering relatively low voltage DC energy to a portion requiring such energy when said apparatus is connected to either of two energy sources, one of said sources providing relatively low voltage DC energy and the other of said sources providing relatively high voltage AC energy, said apparatus comprising a portion requiring for its energization relatively low voltage DC energy of the order of that of said one source, a single pair of input terminals arranged for selective connection to either of said two sources, a semiconductor switch device having a pair of principal electrodes, means connecting said portion and said principal electrodes in series between said terminals, and circuit means connected to said switch device for turning on said switch device continuously, to apply substantially the voltage of said one source across said portion continuously, when said terminals are connected to said one source, and for turning on said switch device for only a part of each cycle of said AC energy when said terminals are connected to said other source, the duration of said parts being such that effectively the same voltage is applied across said portion when said terminals are connected to said other source as is applied across said portion when said terminals are connected to said one source.

3. Apparatus for automatically delivering relatively low voltage DC energy to a portion requiring such energy when said apparatus is connected to either of two energy sources, one of said sources providing relatively low voltage DC energy and the other of said sources providing relatively high voltage AC energy, said apparatus comprising a portion requiring for its energization relatively low voltage DC energy of the order of that of said one source, a single pair of input terminals arranged for selective connection to either of said two sources, a semiconductor switch device having a pair of principal electrodes and a gate electrode, means connecting said portion and said principal electrodes in series between said terminals, and circuit means including resistive and capacitive elements connected to be energized with the energy supplied to said terminals, and including a triggering device connected between said elements and said gate electrode, for turning on said switch device continuously, to apply substantially the voltage of said one source across said portion continuously, when said terminals are connected to said one source, and for turning on said switch device for only a part of each cycle of said AC energy when said terminals are connected to said other source, the parameters of said elements and said devices being made to make the duration of said parts such that effectively the same voltage is applied across said portion when said terminals are connected to said other source as is applied across said portion when said terminals are connected to said one source.

4. Apparatus for automatically delivering relatively low voltage DC energy to a portion requiring such energy when said apparatus is connected to either of two energy sources, one of said sources providing relatively low voltage DC energy and the other of said sources providing relatively high voltage AC energy, said apparatus comprising a portion requiring for its energization relatively low voltage DC energy of the order of that of said one source, a single pair of input terminals arranged for selective connection to either of said two sources, a semiconductor switch device having anode, cathode, and gate electrodes, means connecting said portion and said anode and cathode in series between said terminals, and circuit means including a resistor and a capacitor connected in series between said anode and said cathode, and including a breakdown diode connected between said gate and the junction between said resistor and said capacitor, for turning on said switch device continuously, to apply substantially the voltage of said one source across said portion continuously, when said terminals are connected to said one source, and for turning on said switch device for only a part of each cycle of said AC energy when said terminals are connected to said other source, the parameters of said switch device, said resistor, said capacitor, and said diode being made to make the duration of said parts such that effectively the same voltage is applied across said portion when said terminals are connected to said other source as is applied across said portion when said terminals are connected to said one source.

5. Apparatus as specified in claim 4, wherein said switch device is a silicon controlled rectifier.

6. Apparatus as specified in claim 4, wherein said portion is a solenoid, and wherein a diode is connected across said solenoid.

* * * * *